US007228890B2

(12) United States Patent
Guillaume

(10) Patent No.: US 7,228,890 B2
(45) Date of Patent: Jun. 12, 2007

(54) HEAT EXCHANGER WITH INTEGRAL SHELL AND TUBE PLATES

(75) Inventor: Laudijois Guillaume, Birmingham (GB)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/280,132

(22) Filed: Nov. 15, 2005

(65) Prior Publication Data

US 2007/0107885 A1 May 17, 2007

(51) Int. Cl.
*F28F 9/00* (2006.01)
*F28F 9/02* (2006.01)

(52) U.S. Cl. ..... 165/158; 165/76; 165/DIG. 404

(58) Field of Classification Search ..... None
See application file for complete search history.

(56) References Cited

U.S. PATENT DOCUMENTS 19,197 A * 1/1858 Hoadley ..... 165/158
3,683,866 A * 8/1972 Zmola ..... 122/32
3,804,161 A * 4/1974 Nowak ..... 165/158
4,993,485 A * 2/1991 Gorman ..... 165/85
5,327,957 A * 7/1994 Killebrew ..... 165/161
6,620,969 B1 * 9/2003 Nishimura et al. ..... 562/600
2005/0098307 A1 * 5/2005 Goto ..... 165/146

* cited by examiner

*Primary Examiner*—Allen J. Flanigan
(74) *Attorney, Agent, or Firm*—Chris James

(57) ABSTRACT

A heat exchanger comprises a shell formed from two joined-together shell members. Each shell member includes a tube plate that is integral with each respective shell member and that defines an axial end of the shell member. The shell members are joined along respective open ends. A plurality of tubes is disposed within the shell, and the tube ends are connected with the respective tube plates. A baffle is disposed within the shell and directs the path of coolant flow therein and over the tubes. One shell member includes a fluid inlet and the other a fluid outlet for directing coolant into and out of the shell. The heat exchanger includes an inlet manifold connected to one end of the shell and an outlet manifold connected to an opposite end of the shell.

19 Claims, 4 Drawing Sheets

*Fig. 1*- Prior Art

Fig. 2-Prior Art

HEAT EXCHANGER WITH INTEGRAL SHELL AND TUBE PLATES

FIELD OF INVENTION

This invention relates generally to the field of heat exchangers and, more particularly, to shell and tube heat exchangers that include a shell having an integrated construction that eliminates the overall number of parts and potential leak paths within the heat exchanger.

BACKGROUND OF THE INVENTION

The present invention relates to heat exchangers that are generally configured comprising a number of internal fluid or gas passages disposed within a surrounding body. In an example embodiment, the internal passages are provided in the form of tubes that are designed to accommodate passage of a particular fluid or gas in need of cooling, and the body is configured in the form of a shell or casing to accommodate passage of a particular cooling fluid or gas used to reduce the temperature of the fluid or gas in the internal passages. A specific example of such a heat exchanger is one referred to as a shell and tube exchanger, which can be used in such applications as charge air pre-coolers for use with internal combustion engine systems that make use of a turbocharger or supercharger to boost the pressure of the intake charge directed to the engine for combustion.

Referring to FIGS. 1 and 2, a prior art shell and tube heat exchanger 10 generally includes a casing or shell 12 that includes an internal chamber 14 extending between opposed open axial ends 16 and 18. A plurality of individual tubes 20, i.e., internal passages, are disposed within the internal chamber and are aligned adjacent one another in a spaced apart orientation by use of two tube plates 22 and 24. The tube plates 22 and 24 are positioned at respective open axial ends 16 and 18 of the case 12, and the tubes are sized so that tube ends are positioned adjacent the respective tube plates. The tube ends are sealed to the tube plates to form a leak-tight connection therewith.

The tube plates 22 and 24 are interposed between each shell axial end and a respective inlet and outlet manifold 26 and 28. The inlet and outlet manifolds 26 and 28 are joined to the shell axial ends 16 and 18 by conventional methods, such as welding, brazing, or the like, and are configured to facilitate attachment of the heat exchanger with an air intake system of an internal combustion engine, and to facilitate passage of a liquid or gas to be cooled to and from the plurality of tubes.

The shell 12 includes an inlet connection 30 and an outlet connection 32 that are each attached to a wall surface of the shell, and that are used to facilitate the passage of a cooling medium, fluid or gas, into and out of the shell internal chamber 14. A baffle 34 is disposed within the shell and comprises a plurality of openings to accommodate the passage of the tubes therethrough. The baffle is attached within the casing internal chamber by welding, brazing or the like. The baffle extends radially a partial distance within the internal chamber, and is used to control the flow path of cooling medium within the chamber so that it flows in one radial direction from the inlet connection 30 over a first section of the plurality of tubes, and then flows in an opposite direction over a second section of the plurality of tubes to the outlet connection 22.

Accordingly, such known shell and tube heat exchangers have a construction comprising three components that include the shell and the two tube plates. The use of such a multi-part assembly requires that each such part be independently manufactured, as well as requiring that each of the parts be assembled together. The need to manufacture and assemble these independent parts increases the overall cost of constructing a heat exchanger.

Additionally, the use of these independent parts requires that the manufacturing process have a high degree of accuracy to ensure that the parts fit together properly. Further, the use of such independent parts requires that, during the assembly process, appropriate measures be taken and time spent to ensure the formation of a leak-tight seal between the tube plates and shell. Further, the use of such known shell and tube heat exchanges requires that additional time be spent to correctly position and attach the baffle within the shell.

It is, therefore, desired that a heat exchanger be constructed in a manner that reduces the overall number of components to facilitate manufacturing and assembly efficiency. It is further desired that such heat exchanger be constructed in a manner that reduces the potential for leaks occurring between the shell and the tube plates. It is further desired that such heat exchanger be constructed in a manner that facilitates the process of mounting and/or attaching a baffle therein to further improve assembly efficiency. It is further desired that such heat exchangers be constructed using materials and methods that are readily available to facilitate cost effective manufacturing and assembly of the same.

SUMMARY OF THE INVENTION

A heat exchanger constructed in accordance with principles of this invention generally comprises a shell having an inner chamber defined by an inside wall surface. In an example embodiment, the shell is formed from a pair of joined-together shell members. In such example embodiment, one of the shell member open ends has a diameter section that is sized and shaped to accommodate placement of the other shell member open end therein to form the joined-together connection. One of the shell members includes a fluid inlet for passing coolant into the shell internal chamber, and the other of the shell members includes a fluid outlet for removing coolant from the internal chamber. In an example embodiment, the fluid inlet and fluid outlet are aligned axially with one another along the shell.

Each shell member includes a tube plate comprising a plurality of openings therethrough. The tube plates are integral with each respective shell member and define an axial end of the shell member. Each shell member includes an open end opposite the tube plate and a wall surface interposed therebetween. In an example embodiment, the shell members are joined together along respective open ends.

A plurality of tubes is disposed within the shell, and the tubes have opposed ends that are connected with the respective tube plates. A coolant flow passage extends through the shell inner chamber over the tubes and between the tube plates.

The heat exchanger may also include a baffle disposed within the inner chamber, and interposed between the shell member open ends. The baffle comprises a plurality of openings to accommodate passage of the tubes therethrough. In an example embodiment, the baffle extends a partial distance radially into the shell internal chamber.

One of the shell members includes a fluid inlet for passing coolant into the shell internal chamber, and the other of the shell members includes a fluid outlet for removing coolant from the internal chamber. In an example embodiment, the fluid inlet and fluid outlet are aligned axially with one another along the shell.

The heat exchanger includes an inlet manifold connected to one end of the shell for passing a gas or liquid into the plurality of tubes, and an outlet manifold connect to an opposite end of the shell for receiving the gas or liquid from the plurality of tubes.

Heat exchangers of this invention, comprising shell members having integral tube plates, provide for improved efficiencies in manufacturing and assembling heat exchangers, and further provide for improved service reliability by removing the amount of potential leak paths within the heat exchanger.

BRIEF DESCRIPTION OF THE DRAWINGS

The invention will be more clearly understood with reference to the following drawings wherein.

DETAILED DESCRIPTION OF THE INVENTION

The present invention relates to heat exchangers used for reducing the temperature of an entering gas or fluid stream. A particular application for the heat exchangers of this invention is with vehicles and, more particularly, with internal combustion engine systems comprising a turbocharger or supercharger along with a main charge air cooler to cool a pressurized air stream before it is directed to an intake system of the engine. However, it will be readily understood by those skilled in the relevant technical field that the heat exchanger constructions of the present invention described herein can be used in a variety of different applications.

Generally, the heat exchanger comprises a two-piece shell or casing, wherein each shell comprises an integral or integrated tube plate positioned over an axial end of the shell. The shells are configured to be coupled together in a manner that provides for the placement of a baffle therebetween. Heat exchangers constructed in this manner avoid the manufacturing time and expense associated with constructing separate tube plates and assembling the same to the shell, and avoid the potential for any leakage occurring at the connection joint between the shell and the tube plates.

Figure 1:
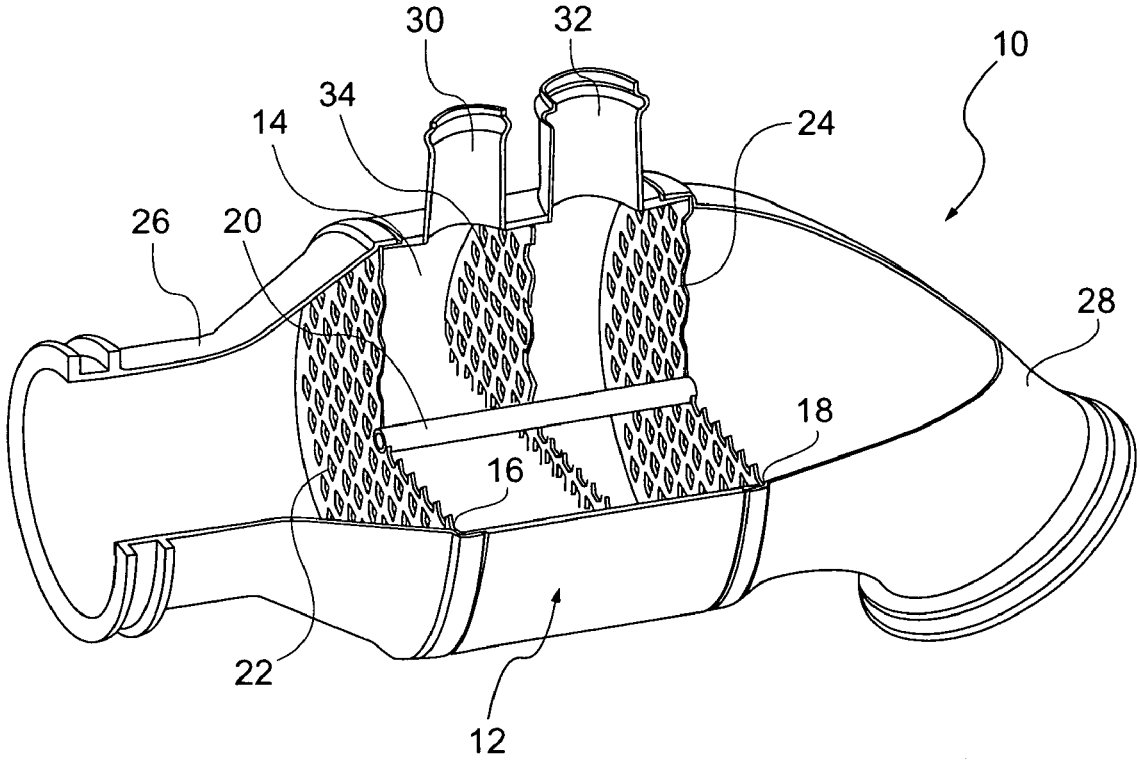
FIG. 1 is a perspective sectional view of a prior art shell and tube heat exchanger.
Figure 2:
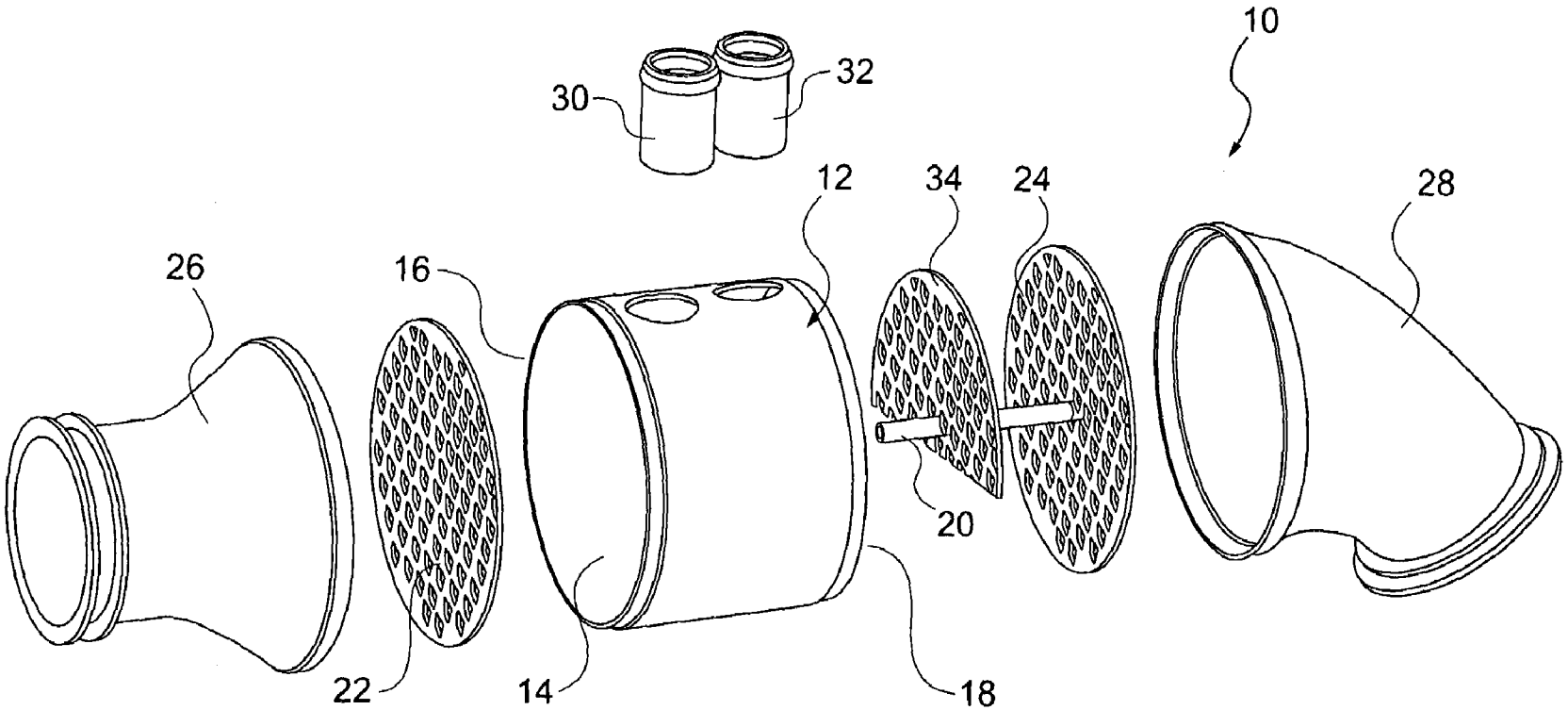
FIG. 2 is an exploded view of the prior art heat exchanger of FIG. 1.
Figure 3:
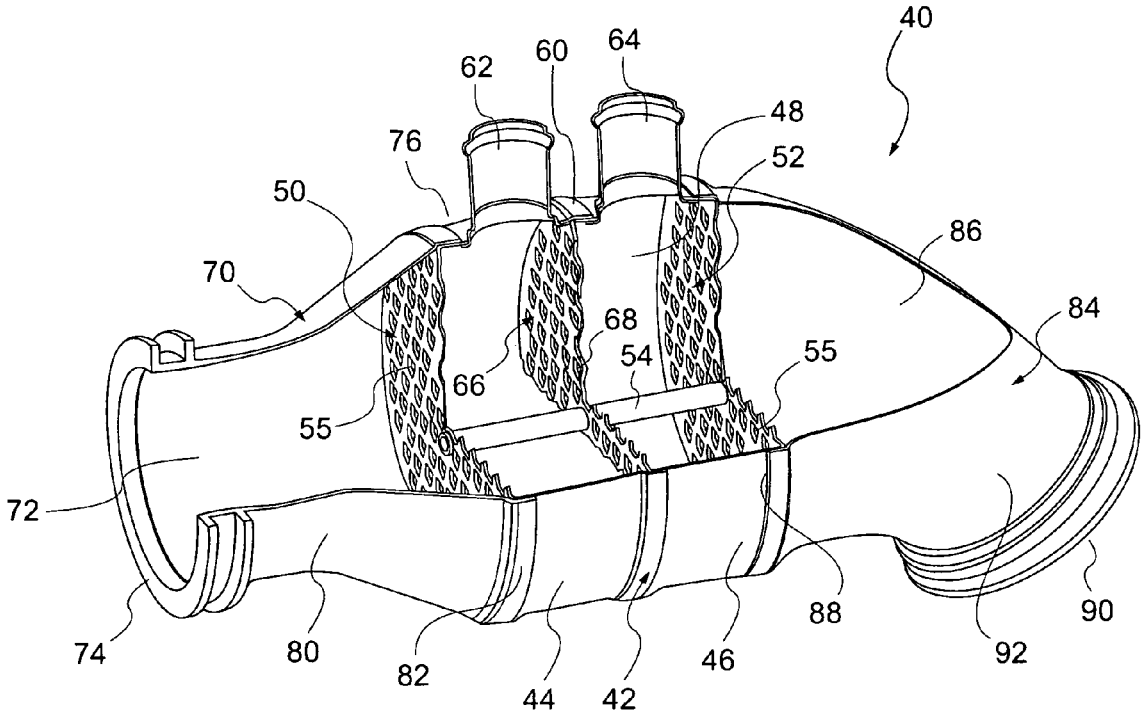
FIG. 3 is a perspective sectional view of a heat exchanger of this invention.
Figure 4:
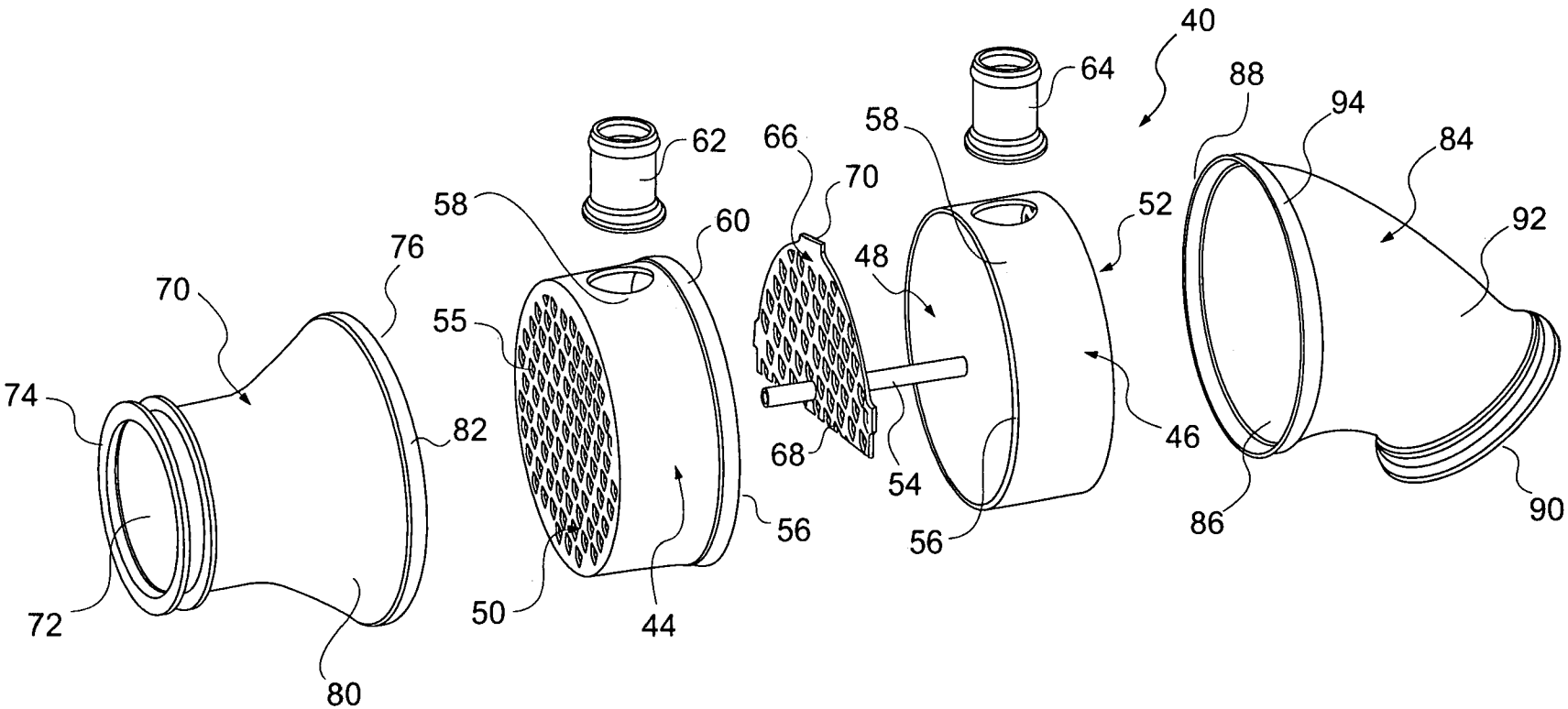
FIG. 4 is an exploded view of the heat exchanger of FIG. 3.

FIGS. 3 and 4 illustrates am example embodiment heat exchanger 40 of this invention, comprising a shell or casing 42 formed from two separate shell or casing members 44 and 46. The shell 42 comprises an internal chamber 48 that extends axially between first and second tube sheets 50 and 52. The internal chamber is sized to accommodate a plurality of tubes 54 therein. The tube sheets comprise a plurality of openings 55 that are configured to accommodate the passage of end portions of the tubes therein to both provide a spaced-apart arrangement of the tubes, and to form a desired leak-tight fitting with the tubes. In an example embodiment, the tube ends are sealed to the openings in the tube sheet by conventional method, such as by welding, brazing, or the like. The formation of such a leak-tight fitting operates to prevent the unwanted intermix of fluid or gas passed through the tubes with the cooling medium and visa versa.

As best shown in FIG. 4, the tube sheets 50 and 52 are integral with a respective shell member 44 and 46. As used herein, the term "integral" is understood to mean that the tube sheets and a respective shell member are a one-piece constructions, are formed from the same type of material, and are one continuous construction.

Each shell member 44 and 46 is configured having an open axial end 56 that is opposite the respective tube sheet. Each shell member has a generally cylindrical wall surface 58 that extends between the open end and the tube sheet. The cylindrical wall surface 58 is sized having an inside diameter that is capable of accommodating a desired number of tubes therein, and to accommodate a desired flow of cooling medium over the outside surfaces of the tubes. In an example embodiment, each shell member 44 and 46 formed from a single piece of material by a casting or stamping/pressing process. In a preferred embodiment, the shell members are made of sheet metal that has been deep drawn to form two cupped parts.

In an example embodiment, e.g., when the heat exchanger is being used as a charge air pre-cooler, it is desired that the pressure drop of the charge air passing through the tubes and the heat exchanger be as low as possible, and have a high temperature resistance but have relatively small heat transfer capability. For this type of application it is desired that the heat exchanger have a large diameter, i.e., have a large inside diameter within the shell internal chamber, relative to the overall shell length.

Materials useful for forming the shell member include those capable of providing a desired structurally rigid construction that is can both retain placement of the tubes therein, and endure the operating temperatures of the heat exchanger. In an example embodiment, the shell members are formed from a metallic material.

The open ends 56 of each shell member are configured to permit attachment with one another to form the overall shell 42. In an example embodiment, the open end 56 of one of the shell members includes a collar 60 having an inside diameter that is slightly larger than that of the open end of the other shell member, and that is configured to fit thereover. The collar 60 has a desired axial depth to facilitate placement of a section of the other shell member open end therein to form a nested attachment therebetween. Configured in this manner, the cooperative open ends operate to facilitate the joining together of the two shell ends to form the overall shell 42. Once the shell members are joined together they can be fixedly attached together by welding, brazing or the like along the outer lip of the collar.

The shell 42 is configured to permit the passage of a cooling fluid, liquid or gas, therein along the outside surface of the tubes disposed within the internal chamber. In an example embodiment, one of the shell members includes a cooling fluid inlet 62 and the other of the shell members includes a cooling fluid outlet 64, wherein the cooling fluid inlet and outlet each pass through the wall surface 58 of each respective shell member. The fluid inlet and outlet are each configured having an outer surface to facilitate attachment with a fluid transport connection member, such as a hose or the like, to facilitate the transport of cooling medium to and from the heat exchanger. In an example embodiment, the shell members are oriented relative to one another before being joined together so that the fluid inlet and fluid outlet are positioned axially adjacent one another, e.g., at the circumferential location along the outside surface of the overall shell. This orientation is useful in heat exchanger constructions where a baffle is positioned within the shell between the inlet and outlet to provide a desired cooling fluid flow path within the shell, as better described below.

The heat exchanger 10 includes one or more baffle 66 disposed within the shell internal chamber. In an example embodiment, the heat exchanger include one baffle 66 that is provided in the form of a flat plate having a plurality of openings 68 to accommodate the passage of the tubes 54 axially therethrough. The baffle 66 can be formed from a suitable structurally rigid material that is capable of functioning as desired under the heat exchanger operating temperatures. In an example embodiment, the baffle is formed from a metallic material.

The baffle 66 operates to control the flow direction of the cooling medium entering the heat exchanger within the shell, over the tubes, and between the tube plates. In an example embodiment, the baffle 66 is configured having a semi-circular configuration and extends half a diameter from an inside wall surface of the shell internal chamber. The baffle 66 is positioned axially within the shell between the fluid inlet 62 and fluid outlet 64, and operates to direct the flow of cooling medium entering the shell from the fluid inlet 62 in a first radial direction over a first axial section of the tubes, and then in a second opposite radial direction over a second axial section of the tubes and to the fluid outlet 64.

The baffle 66 is positioned and attached within the shell 42 between the two shell members 44 and 46. In an example embodiment, the baffle is formed having an diameter sized for placement within the shell member collar 60, and is positioned within the collar before the two shell members are joined together so that the baffle is interposed therebetween. Configured in this manner, the baffle can be easily positioned and installed within the shell without having to be welded, brazed or otherwise affixed independently of the two shell members. Additionally, the shell members can be configured differently to provide a different placement position of the baffle therein depending on the specific end use application and desired cooling medium flow path within the shell.

Although an embodiment of the heat exchanger comprising a single baffle having a particular configuration has been described and illustrated, it is to be understood that heat exchangers of this invention may include more or less than one baffle, and any such baffle can be positioned differently and/or be configured differently than that disclosed.

In an example embodiment, the baffle 66 may include one or more registration members 70 that can be used to help position the baffle relative to the shell members. The registration member 70 can be provided in a form that fits with a cooperative surface feature of one or both of the shell members to ensure a fixed placement position within the shell.

The heat exchanger 10 includes an inlet manifold 70 having an inside chamber 72 that extends between opposed inlet and outlet openings 74 and 76, and that is defined by a wall surface 80. The inlet manifold inlet opening 74 is configured to facilitate attachment with a fluid or gas inlet connection, and the outlet opening 76 is configured for attachment with the shell member 44. In an example embodiment, the inlet manifold outlet opening includes a collar 82 having an inside diameter that is sized to accommodate a portion of the axial end of the shell member 44 comprising the tube sheet 50 therein. Configured in this manner, the inlet manifold is connected to the shell member by placing the shell member axial end within the collar 82 and fixing the attachment by welding, brazing or the like.

The heat exchanger 10 includes an outlet manifold 84 having an inside chamber 86 that extends between opposed inlet and outlet openings 88 and 90, and that is defined by a wall surface 92. The outlet manifold outlet opening 90 is configured to facilitate attachment with an fluid or gas outlet connection, and the inlet opening 88 configured for attachment with the shell member 46. In an example embodiment, the outlet manifold inlet opening includes a collar 94 having an inside diameter sized to accommodate a portion of the axial end of the shell member 46 comprising the tube sheet 52 therein. Configured in this manner, the outlet manifold is connected to the shell member by placing the shell member axial end within the collar 94 and fixing the attachment by welding, brazing or the like.

In general, the entire heat exchanger assembly is preferably made of metals and metal alloys, such as stainless steel of the like, and the assembly elements are brazed into place using a braze material that is compatible with the selected metal or metal allow, e.g., with a nickel-based braze material or the like when the selected material useful for making the heat exchanger elements is stainless steel.

Heat exchangers constructed in accordance with the principles of this invention function in the following manner. The desired fluid or gas to be cooled is directed into the heat exchanger shell 42 via the inlet manifold 70, and into and through the plurality of tubes 54 making up a tube bundle within the shell. The gas or fluid flows through the plurality of tubes and exits the shell via the outlet manifold 84.

A cooling medium or coolant enters the heat exchanger shell via the fluid inlet 62 and is placed into contact with the tubes within the shell. The openings between the assembly of adjacent tubes 54 within the tube bundle defines the coolant flow paths formed between and across the adjacent surfaces of the tubes. The coolant entering the shell flows in a first direction radially through the shell and then changes directions at the end of the baffle and flows in a second direction radially through the shell towards the fluid outlet 64. The coolant flow through the shell operates to reduce the temperature of the gas or fluid being passed through the plurality of tubes via thermal heat transfer.

A feature of heat exchanger constructions of this invention is that, rather than being provided as separate elements, the tube sheets are provided as an integral part shell members. This operates to reduce the overall number of parts, that would otherwise comprise a shell and two separate tube sheets from what was a three-piece assembly to a two-piece assembly, thereby reducing the amount of parts that need to be made improving manufacturing efficiency, and reducing the amount of time needed to assembly the parts improving assembly efficiency. Additionally, the construction of the integral tube sheets results operates to reduce the overall weight of the heat exchanger. Further, reducing the need to attach the tube plates to the shell also reduces the number of joints and leak paths within the construction, thereby eliminating what can be additional potential sources of leaks, that operates to increase the reliability of the heat exchanger.

Another feature of heat exchanger constructions of this invention is the use of two shell members to form the shell, and the related ability through this arrangement to facilitate the mounting of the baffle without further assembly elements or the like. Additionally, this attachment arrangement permits one to easily vary the positioning of a baffle within the shell. As described above, because the baffle is interposed between the two shell members its placement position within the shell can be changed axially by varying the relative axial length of one or both shell members, or radially by simply rotating the baffle relative to the two adjacent shell members.

It is to be understood that the embodiments described above and illustrated are but examples of examples embodiments of heat exchangers as constructed according to principles of this invention, and that those skilled in the art will recognize modifications and substitutions to the specific embodiments disclosed herein. Such modifications are within the scope and intent of the present invention.

What is claimed is:

1. A heat exchanger comprising:

a shell having an inner chamber defined by an inside wall surface, wherein the shell is formed from a pair of joined-together shell members, wherein each shell member includes a tube plate comprising a plurality of openings therethrough, wherein each tube plate is integral with the respective shell member and defines an axial end of the shell member;

a plurality of tubes disposed within the shell, the tubes having opposed ends that are connected with the respective tube plates; and a coolant flow passage extending through the shell inner chamber over the tubes and between the tube plates wherein each shell member includes an open end opposite the respective tube date and a wall surface interposed therebetween, and wherein the shell members are joined together along respective open ends.

2. The heat exchanger as recited in claim 1 further comprising a baffle that is disposed within the inner chamber, and that is interposed between the shell member open ends.

3. The heat exchanger as recited in claim 2 wherein the baffle comprises a plurality of openings to accommodate passage of the tubes therethrough, and wherein the baffle extends a partial distance radially into the shell internal chamber.

4. The heat exchanger as recited in claim 1 wherein one of the shell member open ends has a diameter section that is sized and shaped to accommodate placement of the other shell member open end therein to form a joined-together connection therewith.

5. The heat exchanger as recited in claim 1 wherein one of the shell members includes a fluid inlet for passing coolant into the shell internal chamber, and the other of the shell members includes a fluid outlet for removing coolant from the internal chamber.

6. The heat exchanger as recited in claim 5 wherein the fluid inlet and fluid outlet are aligned axially with one another along the shell.

7. The heat exchanger as recited in claim 1 further comprising:

an inlet manifold that is connected to one end of the shell for passing a gas or liquid into the plurality of tubes; and an outlet manifold that is connect to an opposite end of the shell for receiving the gas or liquid from the plurality of tubes.

8. A method of making a heat exchanger comprising the steps of:

assembling together two shell members to form a shell, each shell member including an internal chamber extending between an open axial end and a tube plate, the tube plate comprising a plurality of openings disposed therethrough, wherein the tube plate is integral with the shell member and defines an opposite axial end of the shell member; and positioning a plurality of tubes within the shell, the tubes having opposed ends that are in contact with the openings through the respective tube plates.

9. The method as recited in claim 8 wherein during the step of assembling, the open ends of the two shell members are joined together by sliding the open end of one shell member into the open end of the other shell member.

10. The method as recited in claim 8 further comprising, before the step of assembling, the step of inserting a baffle between the two shell members, wherein the baffle is inserted between the open ends of the adjacent shell members.

11. A heat exchanger comprising:

a shell having an inner chamber defined by an inside wall surface, wherein the shell is formed from a pair of joined-together shell members, wherein each shell member includes an open end at one axial end, a tube plate at an opposite axial end, and a wall surface extending therebetween, wherein the tube plate comprises a plurality of openings therethrough and is integral with the shell member, wherein the shell members are joined to one another at adjacent open ends;

a baffle disposed within the shell and positioned axially between the open ends of the two shell members, the baffle including a plurality of openings disposed therethrough;

a plurality of tubes disposed within the shell, the tubes extending through the baffle and having opposed ends that are connected with the respective tube plates;

an inlet manifold attached to one end of the shell along the tube sheet of one of the shell members; and an outlet manifold attached to an opposite end of the shell along the tube sheet of the other of the shell members.

12. The heat exchanger as recited in claim 11 wherein one of the shell members includes an open end that is sized to accommodate the open end of the other shell member therein to provide a joined-together connection therebetween.

13. The heat exchanger as recited in claim 11 wherein one of the shell members includes an open end that is sized to accommodate placement of the baffle therein.

14. The heat exchanger as recited in claim 11 wherein the baffle extends a partial distance radially into the shell inner chamber.

15. The heat exchanger as recited in claim 11 wherein the inlet manifold includes an outlet opening sized to accommodate placement of the shell member end therein.

16. The heat exchanger as recited in claim 11 wherein the outlet manifold includes an inlet opening sized to accommodate placement of the shell member end therein.

17. The heat exchanger as recited in claim 11 further comprising a coolant inlet connected to one of the shell members for passing a coolant into the shell inner chamber.

18. The heat exchanger as recited in claim 17 further comprising a coolant outlet connected to the other of the shell members for receiving the coolant from the shell inner chamber.

19. The heat exchanger as recited in claim 18 wherein the coolant inlet and coolant outlet are in axial alignment with one another along an outside surface of the shell.

* * * * *